US005415314A

United States Patent [19]

McCollum

[11] Patent Number: 5,415,314

[45] Date of Patent: May 16, 1995

[54] GRAVITY LOCKING MECHANISM EMPLOYING FIRST AND SECOND PENDULUMS FOR SECURING THE LID OF A REFUSE CONTAINER

[76] Inventor: Chris A. McCollum, 3355 Ninth St., Muskegon Heights, Mich. 49444

[21] Appl. No.: 79,496

[22] Filed: Jun. 21, 1993

[51] Int. Cl.[6] ..... B65D 45/20

[52] U.S. Cl. ..... 220/315; 220/324; 220/908; 220/264; 292/230

[58] Field of Search ..... 220/315, 324, 264, 263, 220/262, 908, 334; 292/230, 236, 238, DIG. 22, 130

[56] References Cited

U.S. PATENT DOCUMENTS

| | | | |
|---|---|---|---|
| 3,011,666 | 12/1961 | Dempster et al. | 414/414 |
| 4,155,584 | 5/1979 | Pracchia | 414/414 |
| 4,438,641 | 3/1984 | Levkov | 70/95 |
| 4,782,674 | 11/1988 | Johnson | 70/95 |
| 5,029,724 | 7/1991 | Serio | 220/908 |
| 5,042,856 | 8/1991 | Goodman | 220/315 |
| 5,090,753 | 2/1992 | Goodman | 220/908 |
| 5,094,358 | 3/1992 | Serio, Sr. | 220/315 |
| 5,094,487 | 3/1992 | Drewry | 220/908 |
| 5,118,000 | 6/1992 | Howell et al. | 220/315 |
| 5,135,129 | 8/1992 | Joly | 220/315 |
| 5,149,153 | 9/1992 | Drewry et al. | 220/908 |
| 5,160,060 | 11/1992 | Garofalo, Jr. | 220/908 |
| 5,201,434 | 4/1993 | De Vivo et al. | 220/908 |

*Primary Examiner*—Stephen J. Castellano

[57] ABSTRACT

A locking mechanism for a refuse container that includes a pivotally mounted bracket system that constitutes a first pendulum, for securing the lid of the refuse container and a catch which can be moved from a potentially engageable position to an unengageable position to control movement of the bracket system. The catch constitutes a second pendulum. During an automated emptying of the refuse container, the pendulums are timed so that the catch opens first, thereby allowing the bracket system to pivot and the lid to open.

3 Claims, 3 Drawing Sheets

GRAVITY LOCKING MECHANISM EMPLOYING FIRST AND SECOND PENDULUMS FOR SECURING THE LID OF A REFUSE CONTAINER

BACKGROUND OF THE INVENTION

The invention relates to a locking arrangement for the lid of a refuse container. More specifically, the invention relates to an arrangement wherein a manual, as well as a gravity, responsive locking device is provided.

As is well known, dumping unauthorized refuse into someone else's open refuse container is a wide spread and well known practice. In some circumstances, unlocked refuse containers have attracted children who employ them as play areas. There are other cases wherein homeless people have crawled into unlocked refuse containers for shelter. Unquestionably there is a need for a simple cost effective locking mechanisms.

Other than the obvious, the problems with locking the lids of refuse containers becomes more complex when it is appreciated that most refuse containers are dumped by mechanical means. That is, the refuse container is grasped in some manner by a mechanical system which then empties the refuse from the container into a truck-borne receiving bin. A mechanical manual locking system for the most part would require that the driver leave the truck and actuate the manual system. Should this require a key, the driver would have to have a key for every lock on his route. Should it involve the removing of chains or hooks or other things of that nature, again the driver would have to exit the vehicle and then concern himself as to the location of those items as the refuse container is maneuvered and dumped into the receiving bin on his truck.

Any mechanical type situation which requires the driver to leave his truck unattended with the motor running, is hazardous and time consuming. The result is that in many cases, the lids of refuse containers are left unlocked, subject to the initially discussed problem. A new liability which has been presented to both the generator and the hauler, is the unauthorized dumping of very hazardous materials. In such circumstances where third parties dump these materials into the unlocked refuse container, both the generator and the hauler are held equally liable in the eyes of the law.

DESCRIPTION OF THE PRIOR ART

Applicant is aware at least three prior art devices which respond to the pull of gravity to actuate a locking mechanism. The first of these involves wedge systems and is manufactured by Serio-US, Ind. of Annapolis, Md. Applicant believed that U.S. Pat. No. 5,094,358, to Joseph L. Serio, Sr. entitled "Locking Mechanism For Container Lid" issued Mar. 10, 1992, related to this device. The second involves a disk which rolls back and forth again in a track and is manufactured by Wastetech of Walker, Mich. The third device employs counterweight mechanisms that are housed in receptacles at the ends of the refuse container. As the refuse container is dumped into the truck-borne receiving bin, these counterweights apparently fall forward to actuate the locking device. Applicant believes that U.S. Pat. No. 4,155,584, to Pletro G. Pracchia entitled "Automatic Locking Mechanism For Refuse Container" relates to this device.

Accordingly, it is object of the present invention to provide a locking mechanism which has a dual capacity in that it can be manually actuated or actuated in response to the pull of gravity. Yet a further object is to provide a gravity-actuated device which opens and closes the lid lock in response to the pull of gravity. But another object is to provide a gravity actuated lock device for a refuse container which will open or close the lid lock at a predetermined point during the mechanical cycle wherein the refuse is transferred from the refuse container to a truck-borne receiving bin.

SUMMARY OF THE INVENTION

In accordance with the invention, there is presented a locking mechanism which is dual in nature whereby selective access to a secured refuse container is achieved. In the broadest sense, a refuse container is a means capable of receiving refuse and is generally defined as a closed structure having a void within and having at least one portion or lid which can be opened whereby allowing access to the void within. In the vast majority of cases, the refuse container itself is provided with some means which are designed for cooperating or being grasped/manipulated by another means mounted, for example, on a truck or other type of rubber-tired vehicle. The means mounted on the refuse container and the mechanical means mounted on the truck engage and allow the picking up and emptying of the refuse from the refuse container into the receiving bin mounted on the truck. The first locking device of the dual system herein provided is a standard locking device being employed by the janitor, for example, as authorized refuse is dumped into the refuse container. The second locking device is associated with a pendulum or counterweight which moves a catch in the same manner as the janitor does with his key, but at some predetermined position as the truck-borne mechanism is maneuvering the refuse container during the dumping cycle. In a preferred embodiment, the truck-mounted mechanism swings the refuse container along a portion of a generally arch-shaped path. As the pendulum or counterweight passes along this arch-shaped path, the pull of gravity remains constant on it causing it to rotate. At a predetermined point just as it is necessary to dump the refuse, the pendulum has rotated the catch sufficiently to avoid engagement with a shackle so that a lid securing bar can move to allow the lid on the refuse container to open ensuring that the refuse is properly deposited within the vehicle-mounted receiving bin. As the refuse container travels back along the same partial arc, all the elements respond in the reverse order, that is the lid closes, the locking system engages the lid and then the pendulum responding to the pull of gravity swings the catch back into a position whereby engagement with the shackle is possible. The result is that the container is locked to unauthorized opening when it is initially engaged by the truck-borne mechanism and it is in the same condition when the truck-borne mechanism returns it to the ground empty of refuse. Most importantly, the driver has never had to leave the confines of the cab.

BRIEF DESCRIPTION OF THE DRAWINGS

The invention will be better understood in examination of the following description, together with the accompanying drawings in which.

DETAILED DESCRIPTION OF THE PREFERRED EMBODIMENT

Figure 1:
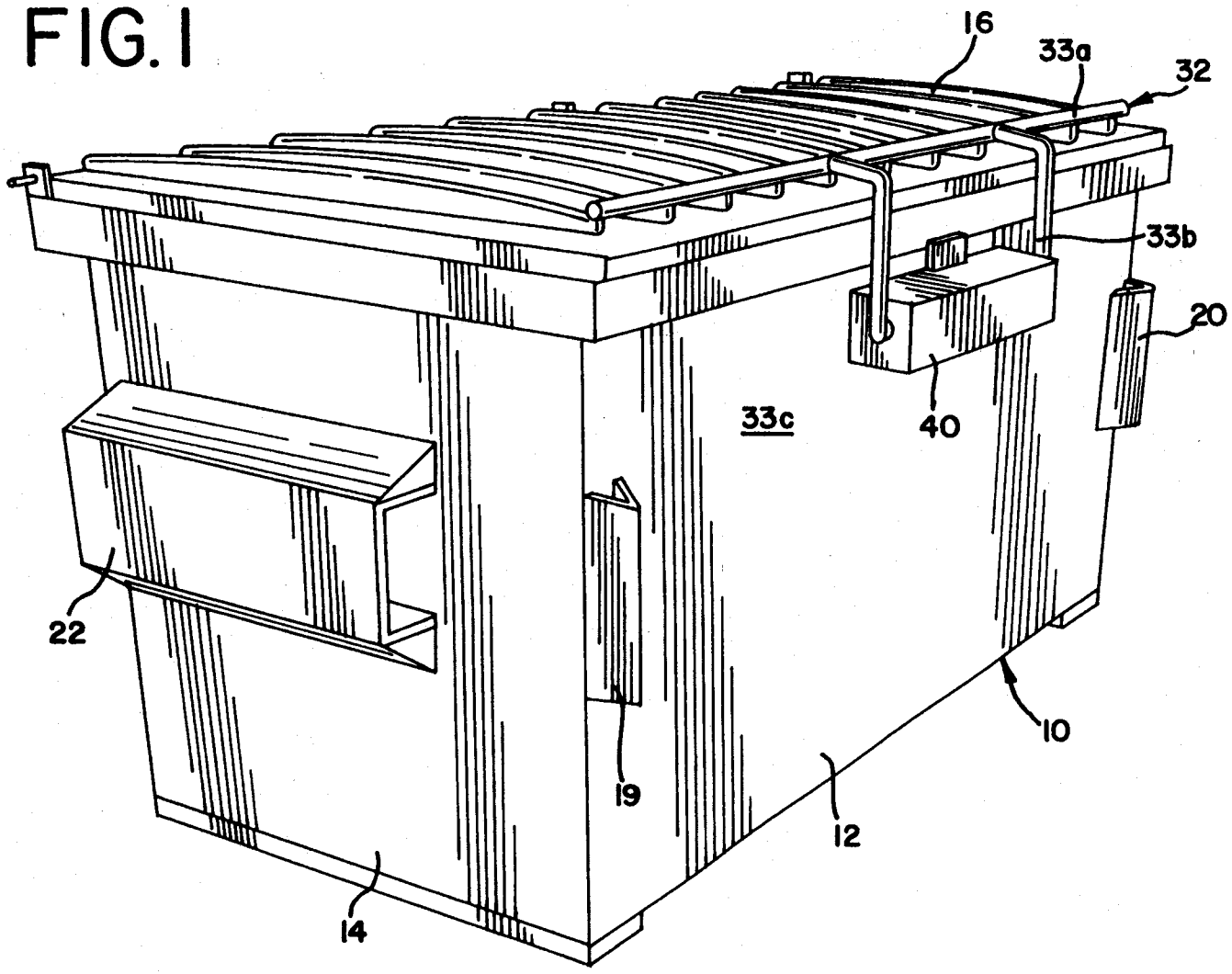
FIG. 1 illustrates a refuse container showing the locking mechanism hereunder consideration.
Figure 2:
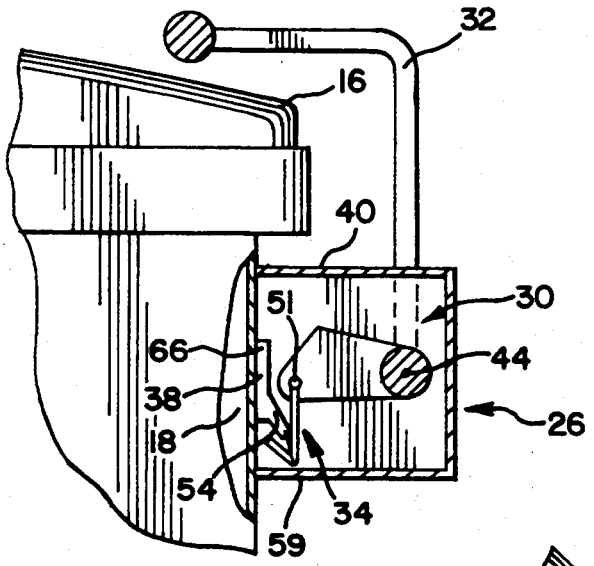
FIG. 2 is an end section view of the gravity portion of the locking mechanism in the at rest position.

Referring now to the drawings and in particular to FIG. 1 thereof, wherein is illustrated a preferred embodiment of the present invention. The refuse container 10 in this particular embodiment has walls such as 12 and 14, as well as a back wall, an end wall, and a bottom which are not illustrated. It is basically a closed structure having a lid 16 or portion which can be opened whereby allowing access to the void 18 as shown in FIG. 2. Stops 19 and 20, as well as a pair of sleeves, only 22 of which is shown, are provided to facilitate engagement with the external mechanism carried on the dump truck. As is apparent the sleeve 24 which is not shown, is identical to sleeve 22 but at the other end of the refuse container 10. In this particular embodiment they are designed to receive the tines of a fork lift-like device extending off the front of a garbage truck. That is, the truck drives into the refuse container 10 such that the stops 19 and 20 engage the front bumper and the tines of the fork lift device pass into the openings in the sleeves. Once so grasped the refuse container 10 is hoisted into the air to travel up over the hood and windshield of the cab to a point where it is dumped into the receiving bin carried on the truck. All of this is standard and well known in the prior art and no further reference will be made thereto. It should be, however, understood that the particular external mechanism mounted on the truck and the particular mechanism employed on the refuse container will vary from operation to operation. However, the invention herein disclosed, once understood, can apply to all such refuse containers as well as their operations.

Figure 3:
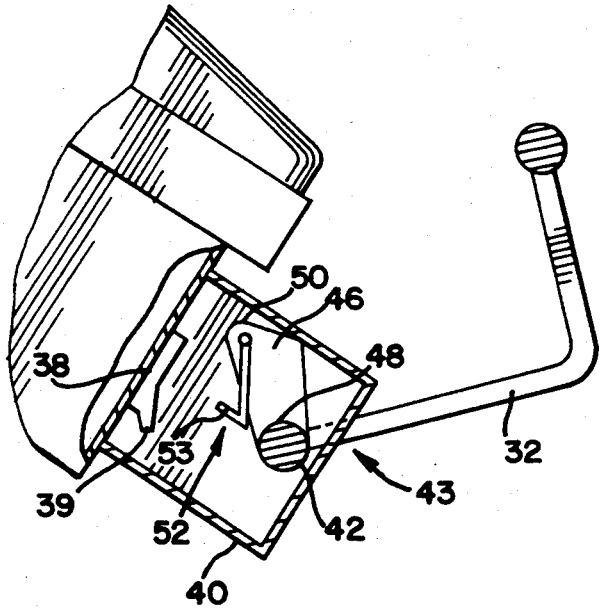
FIG. 3 is an end section like FIG. 2 with the locking mechanism in the open position.
Figure 5:
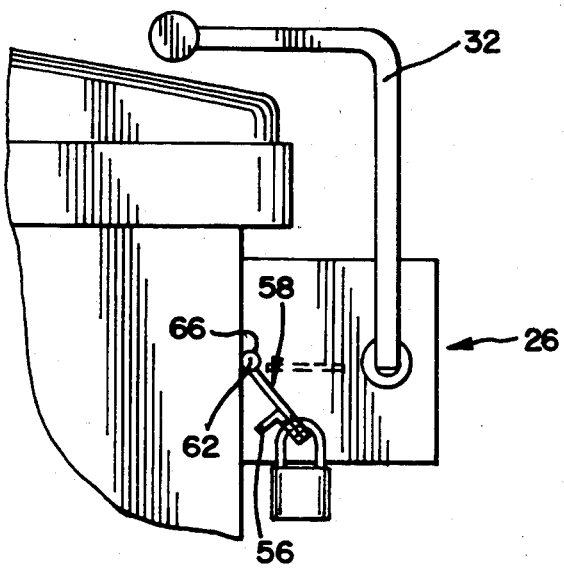
FIG. 5 is an end view showing the manual portion of the locking mechanism.

In the broadest sense, the invention is for controlling access to a refuse container, such as 10, which has an internal space 18 therein. At least a single movable lid, such as 16, allows access to the space within. The locking mechanism 26, as shown in FIGS. 2 and 5, includes a manual lock device 28 and a gravity lock device 30. The gravity lock device 30 includes a lid securing bar 32 which can move with respect to the refuse container 10 in response to the pull of gravity and thus controls the state or the freedom of the lid 16 (see FIG. 1). That is, when the lid securing bar 32 is in a position shown in FIGS. 1 and 2, the lid 16 cannot be opened, however, if the lid securing bar 32 is in the position shown in FIG. 3, it is apparent that the lid 16 can be freely opened. The other critical element is a catch 34 which can move freely, both with respect to the refuse container 10 and the lid securing bar 32, in response to the pull of gravity. In this manner, the catch 34 controls the state of the lid securing bar 32, that is, it is in the engageable position in FIG. 2 and the non-engageable position as shown in FIG. 3. Note, once opened, the lid securing bar 32 can move freely with respect to the refuse container 10 and the catch 34.

On a more detailed basis, the gravity lock device 30 include a series of elements all designed to cooperate and function in a particular manner. These include an immovable shackle 38 which is secured to the refuse container 10, as shown in FIGS. 2 and 3. A support housing 40 is also secured to the refuse container 10 and carries therein a mounting system 43 that includes an elongated bar 42 which rotates along its major axis 44 shown in FIG. 4. Any suitable bearing can be provided between the support housing 40 and the elongated bar 44. The lid securing bar 32 as previously mentioned, consists in this particular embodiment of a series of bars 33*a*, 33*b* and 33*c*, bent to facilitate attachment to the elongated bar 42 and at the same time extend outwardly whereby it is in a position to control the movement of the lid 16. The particular shape and configuration is determined only by the nature of the lid which is desired to control and its center of gravity. A critical element is that the lid securing bar 32 constitutes a first pendulum as secured to the container 10 by mounting system 43 whereby free movement therebetween is possible. As stated in the preferred embodiment, this is accomplished by rotation around axis 44 of bar 42. Next is provided a catch link 46 which has first and second ends 48 and 50, said first end 48 being fixed to said elongated bar 42. The catch 34 is pivotally secured to the second end 50 via a catch pivot point 51 and includes a hook portion 52. The hook portion 52 is designed to be trapped by the immovable shackle 38 when the refuse container 10 is in its normal at rest position, such as shown in FIG. 1 when unauthorized entry is attempted.

Reference to FIG. 2 demonstrates that should the lid securing bar 32 be forcibly rotated around the axis 44, the hook portion 52 cannot be dislodged from engagement with the immovable shackle 38. That is, if the lid securing bar 32 is hit back and forth rapidly around axis 44 in an attempt to cause catch 34 to disengage from immovable shackle 18, an additional feature of this invention become apparent. Firstly, as a result of the location of the catch pivot 51 and the center of gravity of the catch itself, the catch 34 and the immovable shackle 38 contact at point 59 when the container 10 is in its normal position shown in FIG. 1 and FIG. 2. Thus, to some degree vibrations created in catch 34 by the unauthorized entry attempt are dampened out by the immovable shackle 38.

Another feature of this invention is also shown in FIGS. 2 and 3. As shown in FIG. 2, the refuse container is in an at rest condition and the gravity lock device 30 is not positively engaged, but rather in a position whereby should an attempt be made to gain unauthorized entry, only then will positive engagement occur. That is, other than the contact at point 59, the hook portion 52 of catch 34 is not engaged with the tip 39 of the immovable shackle 38. To allow opening of the container lid 16, the catch 34 need rotate around catch pivot point 51. There are no wedges being moved, there are no weights striking an arm, nor are any balls being rolled. Applicant has provided a gravity locking device which during all times, except when unauthorized entry is attempted, is not positively engaged. Only when unauthorized entry is attempted does the gravity locking device positively engage. During normal authorized entry, the gravity locking device employs two pendulums which function in a predetermined manner to first open the catch 34 to a potentially non-engageable position and secondly, to disengage a refuse container lid securing bar 32 to that the lid can open. The manual lock device accomplishes the same results, but by a manual procedure.

Figure 4:
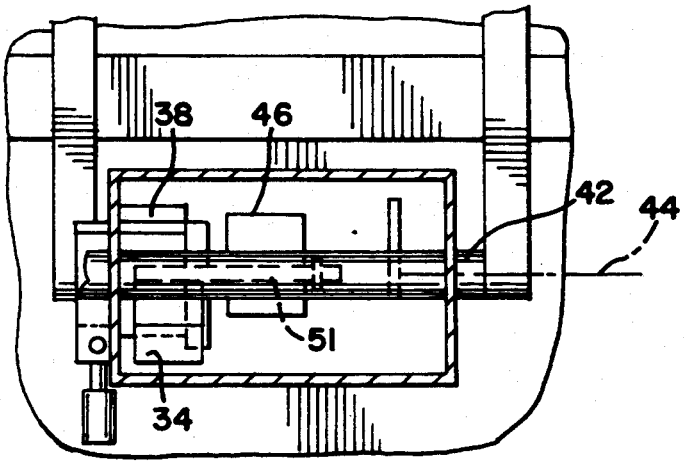
FIG. 4 is a front section view like FIG. 2 with the locking mechanism in the at rest position.

Referring to FIG. 4 it becomes apparent that the immovable shackle 38 constitutes an elongated bar and the catch 34 is also a flat bar having a bent portion which constitutes the hook 52. As such, these elements constitute strong durable elements susceptible to substantial abuse. It should be appreciated that in this embodiment, the catch 34 constitutes the second pendulum which can move independent of the other mechanisms in response to the pull of gravity.

In operation, when it is desirable to empty the refuse, the refuse container 10 is grasped by the particular external mechanism mounted on the truck. As stated, the refuse container 10 will be passed along a predetermined path during the dumping and returning to the ground cycle. Initially, the refuse container 10 and the gravity locking device are at rest (as shown in FIG. 2), which constitutes an unengaged, but potentially engageable, position. As the refuse container 10 is passed initially along the curved path because the catch 34 and the lid securing bar 32 are freely pivotal, both with respect to each other and with respect to the refuse container, they will independently respond to the pull of gravity. In the proper sequence, these first and second pendulums, respectively, must be balanced such that the second pendulum controlling the catch 34 (which in the preferred embodiment are one in the same), swings the hook 52 away from the immovable shackle 38 first. This action must come prior to any movement of the lid securing bar 32 (which in the preferred embodiment also constitutes the first pendulum). Referring to FIG. 3, it is apparent that once the catch 34 has moved to an unengageable position, the pull of gravity acts upon the lid securing bar 32 causing it to disengage from the lid 16 allowing it to open with the subsequent dumping of any refuse contained in the void 18.

As is known, the action of dumping the refuse from the container 10, can invoke the violent shaking of the container 10. Assuming the lid securing bar 32 were to be rotated around axis 44, the maximum amount when the container was in position represented by FIG. 3, because of the location of catch pivot point 51 and the positioning of the center of gravity of catch 34, it is very unlikely that hook 52 would engage immovable shackle 38.

In the reverse order, as the refuse container 16 moves down the return path toward the ground, the lid 16 closes, next the lid securing bar 32 as a result of the action of the first pendulum swings back to secure the lid. Next, the pull of gravity acting upon the catch 34, swings it back to the potentially engageable position, as shown in FIG. 2, at some predetermined point of travel.

Figure 6:
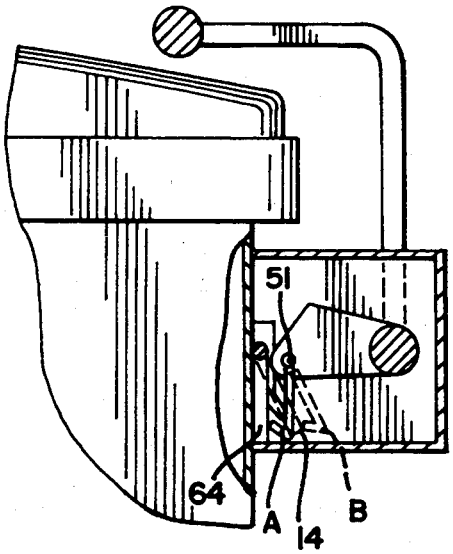
FIG. 6 is a partial end view showing the operation of the manual locking mechanism.
Figure 7:
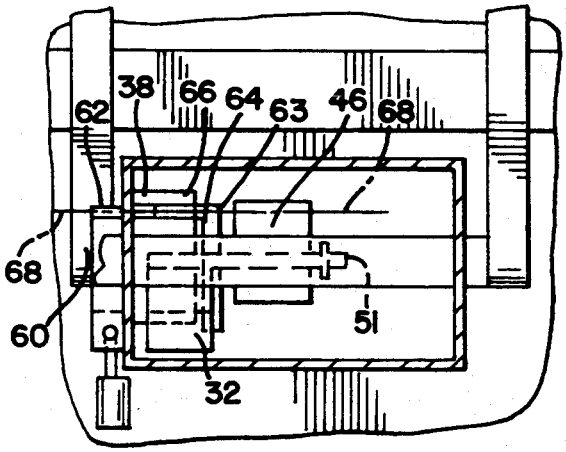
FIG. 7 is a front section view of FIG. 5.

Referring now to FIGS. 5, 6 and 7, wherein the manual lock system is described. As is appreciated, any type of manual lock system which allows the janitor or some other authorized person to achieve access, can be provided and is acceptable. In this particular embodiment a standard padlock 28 secures a generally C-shaped plate 58 against movement. The C-shaped bracket 58, as shown in FIGS. 5 and 7, has a first elongated portion 60, a rod-shaped portion 62 and attached at the end 63 of rod 62 a bypass device 64, all of which define a generally C-shaped configuration. The rod-shaped portion 62 is carried in a hole 66 which also functions in the nature of a bearing. When the lock 28 is disengaged, the portion 60 can be grasped and rotated about the major axis of rod 62 causing the bypass device 64 to move upwardly as shown in FIG. 6 from position A to position B wherein the catch 34 cannot engage the immovable shackle 38. The lid securing bar 32 can then be rotated to the right, as shown in FIG. 6, around the axis 44 allowing the lid 16 to be opened.

Now that the preferred embodiment of the present invention has been shown and described, various modifications and improvements will become readily apparent to those skilled in the art. Accordingly, the spirit and scope of the present invention is to be limited only by the appended claims, and not by the foregoing disclosure.

I claim:

1. A locking mechanism whereby selective access to a secured refuse container is achieved, said refuse container being generally a closed structure having a void within and having a lid which can be opened whereby allowing access to said void within, a means secured to said refuse container designed for cooperation with an external truck mounted mechanism whereby said refuse container can be manipulated for dumping, said locking mechanism comprising:

a gravity locking device secured to said refuse container having a first lid securing bar pendulum and a second catch pendulum for securing said lid whereby at a predetermined point during said manipulation of said refuse container, said second catch pendulum activates, and at another predetermined point during said manipulation said first lid securing bar pendulum activates, whereby said lid is free to open;

a mounting system securing said first lid securing bar pendulum to said container whereby movement is possible therebetween in response to the pull of gravity;

a catch pivot securing said second catch pendulum to said mounting system whereby movement is possible therebetween in response to the pull of gravity and said second catch pendulum remains free from engagement unless unauthorized entry to said refuse container is attempted; and a manual lock associated with said gravity locking device for activating said second catch pendulum whereby said lid may be opened.

2. A locking mechanism whereby selective access to a secured refuse container is achieved according to claim 1 wherein said gravity locking device includes: an immovable shackle secured to said container; and said mounting system is a rotatable shaft.

3. A refuse container defining an internal space and having a lid which controls access to said internal space, a means secured to said refuse container for cooperating with an external truck mounted mechanism whereby said refuse container may be picked up, passed along a predetermined path incident to dumping thereof, a locking mechanism for controlling movement of said lid comprising:

a gravity locking device including:

an immovable shackle secured to said refuse container;

a support housing secured to said refuse container carrying an elongated bar rotatable around its major axis;

a lid securing bar being fixed to said elongated bar and extending outwardly whereby preventing said lid from being opened, said lid securing bar including a first pendulum;

a catch link having first and second ends, said first end being fixed to said elongated bar;

a hook pivotally secured to said second end of catch link which can be selectively trapped by said immovable shackle, said hook including a second pendulum, whereby when said refuse container is passed along said predetermined path incident to dumping said hook responding to the pull of gravity moves, whereby said hook is unengageable with said immovable shackle and then said first pendulum responding to the pull of gravity effects said lid securing bar whereby releasing said lid to open and dumping to take place; and a manual lock device associated with said gravity locking device for activating said hook whereby said lid may be manually opened.

* * * * *